US007413617B2

(12) United States Patent
Ikeda et al.

(10) Patent No.: US 7,413,617 B2
(45) Date of Patent: Aug. 19, 2008

(54) COMPOSITE STRUCTURE SHEET STEEL WITH EXCELLENT ELONGATION AND STRETCH FLANGE FORMABILITY

(75) Inventors: Shushi Ikeda, Kobe (JP); Koichi Sugimoto, Nagano (JP); Yoichi Mukai, Kakogawa (JP); Hiroshi Akamizu, Kakogawa (JP)

(73) Assignees: Kabushiki Kaisha Kobe Seiko Sho, Kobe-shi (JP); Shinshu TLO Co., Ltd., Ueda-shi (JP)

( * ) Notice: Subject to any disclaimer, the term of this patent is extended or adjusted under 35 U.S.C. 154(b) by 0 days.

(21) Appl. No.: 11/290,640

(22) Filed: Dec. 1, 2005

(65) Prior Publication Data

US 2006/0130937 A1 Jun. 22, 2006

(30) Foreign Application Priority Data

Dec. 21, 2004 (JP) ..... 2004-369312

(51) Int. Cl.
*C22C 38/02* (2006.01)
*C22C 38/06* (2006.01)
*C21D 8/02* (2006.01)

(52) U.S. Cl. ..... 148/320; 148/331; 148/332; 148/336; 148/603; 148/652

(58) Field of Classification Search ..... 148/320, 148/331, 332, 603, 651, 652, 336
See application file for complete search history.

(56) References Cited

U.S. PATENT DOCUMENTS 4,501,626 A * 2/1985 Sudo et al. ..... 148/320
6,290,784 B1 * 9/2001 Yasuhara et al. ..... 148/320
6,306,527 B1 10/2001 Ikeda et al.
6,316,127 B1 11/2001 Ikeda et al.
2003/0084966 A1 5/2003 Ikeda et al.

(Continued)

FOREIGN PATENT DOCUMENTS

EP 0922782 * 6/1999

(Continued)

OTHER PUBLICATIONS

U.S. Appl. No. 11/290,640, filed Dec. 1, 2005, Ikeda et al.

(Continued)

*Primary Examiner*—Deborah Yee
(74) *Attorney, Agent, or Firm*—Oblon, Spivak, McClelland, Maier & Neustadt, P.C.

(57) ABSTRACT

The present invention provide a TRIP-type composite structure steel plate of the TPF steel type in which elongation and stretch flange formability at room temperature are improved by controlling the morphology of the second-phase structure. In a composite structure sheet steel comprising 0.02 to 0.12% C, 0.5 to 2.0% Si+Al and 1.0 to 2.0% Mn, with the remainder being Fe and unavoidable impurities, and comprising 80% or more polygonal ferrite (steel structure space factor) and 1 to 7% retained austenite, with the remainder being bainite and/or martensite, wherein the elongation and stretch flange formability of the composite sheet steel are improved by reducing the number of bulky, massive second phases with an aspect ratio of 1:3 or less and a mean grain size of 0.5 μm or more in the second phase of this composite structure, which comprises retained austenite and martensite.

11 Claims, 1 Drawing Sheet

U.S. PATENT DOCUMENTS

| | | | |
|---|---|---|---|
| 2004/0007298 | A1 | 1/2004 | Akamizu et al. |
| 2004/0035500 | A1 | 2/2004 | Ikeda et al. |
| 2004/0074575 | A1 | 4/2004 | Kashima et al. |
| 2004/0159373 | A1 | 8/2004 | Ikeda et al. |
| 2004/0226635 | A1 | 11/2004 | Ikeda et al. |
| 2005/0081966 | A1 | 4/2005 | Kashima et al. |
| 2005/0133124 | A1 | 6/2005 | Kawano et al. |
| 2005/0150580 | A1 | 7/2005 | Akamizu et al. |
| 2005/0161134 | A1 | 7/2005 | Ikeda et al. |
| 2005/0167007 | A1 | 8/2005 | Miura et al. |
| 2005/0247378 | A1 | 11/2005 | Ikeda et al. |
| 2006/0130937 | A1 | 6/2006 | Ikeda et al. |

FOREIGN PATENT DOCUMENTS

| | | | | |
|---|---|---|---|---|
| EP | 0922782 | A1 | * | 6/1999 |
| JP | 2-97620 | | | 4/1990 |
| JP | 406065677 | | * | 3/1994 |
| JP | 9-104947 | | | 4/1997 |
| JP | 410204576 | | * | 8/1998 |
| JP | 11-323490 | | * | 11/1999 |
| JP | 2001-220641 | | * | 8/2001 |
| JP | 2003-129172 | | * | 5/2003 |
| JP | 2004-43908 | | | 2/2004 |
| JP | 2004-91924 | | | 3/2004 |

OTHER PUBLICATIONS

U.S. Appl. No. 11/317,174, filed Dec. 27, 2005, Yuse et al.
U.S. Appl. No. 11/317,181, filed Dec. 27, 2005, Yuse et al.
Patent Abstracts of Japan, JP 10-204576, Aug. 4, 1998.
Patent Abstracts of Japan, JP 05-331591, Dec. 14, 1993.
Patent Abstracts of Japan, JP 2000-169936, Jun. 20, 2000.
Patent Abstracts of Japan, JP 2000-234129, Aug. 29, 2000.
"Current Advances in Materials and Processes", Report of the Iron and Steel Institute of Japan Meeting, vol. 7, No. 3, Mar. 2, 1994, 4 pages.
"Current Advances in Materials and Processes", Report of the Iron and Steel Institute of Japan Meeting, vol. 8, No. 3, Apr. 4, 1995, 7 pages.
U.S. Appl. No. 11/910,029, filed Sep. 28, 2007, Akamizu et al.
U.S. Appl. No. 11/910,013, filed Sep. 28, 2007, Kashima et al.
U.S. Appl. No. 11/874,516, filed Oct. 18, 2007, Ikeda et al.

* cited by examiner

COMPOSITE STRUCTURE SHEET STEEL WITH EXCELLENT ELONGATION AND STRETCH FLANGE FORMABILITY

BACKGROUND OF THE INVENTION

1. Field of the Invention

The present invention relates to a 590 MPa grade high-strength TRIP (strain-induced transformation) cold-rolled sheet steel with excellent elongation, stretch flange formability and formability. In the present invention, the cold-rolled sheet steel encompasses not only cold-rolled sheet steels without surface treatment but also cold-rolled sheet steels which have been surface treated by electroplating, hot dipping, chemical surface treatment or surface coating or the like.

2. Description of the Related Art

The aforementioned sheet steel can be used effectively in a wide range of industrial fields such as automobiles, electricity, machines and the like, but the following explanation focuses on automobile bodies as a typical application.

The requirements for high-strength sheet steel have increased greatly due to efforts to reduce fuel costs by reducing the weight of automobile sheet steel while giving primary consideration to ensuring safety in case of collision. Recently, these requirements have been further increased in an effort to protect the environment by reducing emissions.

However, formability requirements are strong even for high-strength steel, which must have formability suited to a variety of applications. In particularly, in automobile panel and frame applications in which the steel is press formed into complex shapes, there is demand for high-strength sheet steel which has both stretch formability (ductility, i.e., elongation) and stretch flange formability [hole expandability (local ductility)].

One kind of high-strength, high-ductility sheet steel which has been developed with the aim of providing the required properties of excellent strength and ductility while reducing automobile weight and improving collision safety is TRIP (transformation-induced plasticity) steel. This TRIP steel has a mixed structure of ferrite, bainite and retained austenite with retained austenite (γR) being produced in the structure. When this steel is processed to deform at a temperature at or above the martensitic transformation start point (Ms point), it undergoes considerable elongation due to induced transformation of the retained austenite (γR) into martensite by the action of stress.

Known examples include TRIP-type composite-structure steel (TPF steel), which comprises polygonal ferrite as the matrix phase and retained austenite, TRIP-type tempered martensite steel (TAM steel), which comprises tempered martensite as the matrix phase and retained austenite, and TRIP-type bainite steel (TBF steel), which comprises bainitic ferrite as the matrix phase and retained austenite.

Of these, efforts have been made in the past to develop TPF steels which are high-strength sheet steels with good workability. For example, Japanese Patent Application Laid-open No. H02-097620 (Claims) describes that a high-strength sheet steel with good workability can be obtained by first heating to the bainitic transition temperature range and then maintaining that temperature for a specific time ("austempering"), concentrating and stabilizing the high-diffusion-constant C in the undeformed austenite so that the austenite can be retained without being transformed into martensite at room temperature.

Due to the present focus on achieving both ductility and workability as mentioned above, however, elongation and stretch flange formability need to be further improved. In particular, stretch flange formability is a property which is required for sheet steel used in automobile chassis parts and the like and for sheet steel for auto bodies which is heavily worked. Consequently, the stretch flange formability of TRIP sheet steel needs to be improved in order to promote its use in auto chassis parts and the like, for which the weight-reducing effects of TRIP sheet steel are particularly anticipated.

Therefore, a variety of research has already been done into TPF steel with the aim of providing sheet steel which has excellent formability including stretch flange formability (hole expandability) while maintaining a balance between ductility and strength from γR. For example, Japanese Patent Application Laid-open No. H09-104947 (Claims) discloses a sheet steel which, while hot-rolled, has a microstructure composed of the three phases of ferrite, bainite and γR, wherein the ratio of the occupying rate of ferrite to grain size of ferrite and the occupying rate of γR are controlled within a specific range. This is based on the finding that while increasing γR improves the strength-ductility balance and increases total elongation, this effect can be enhanced by decreasing the grain size of the γR, and in particular formability including stretch flange formability is increased when the γR is finer. The problem, however, is that the actual improving effect on stretch flange formability is small.

It has been said that a second phase consisting of γR and martensite has an effect on extension flange formability in TRIP composite structure sheet steels. From this perspective, since the amount of stress-induced transformation of γR can be controlled by means of the working temperature in particular, a method has been proposed of improving stretch flange formability by warm working TRIP steel at between 50 and 250° C. to form the γR of the second phase into fine needles.

For example, in Nagasaka, Akihiko, Koichi Sugimoto and Mitsuyuki Kobayashi, "Improving the extension flange formability of high-strength sheet steel with the transformation-induced plasticity of retained austenite," Materials and Processes (Iron and Steel Institute of Japan, Collected Papers), CAMP-ISIJ 35 (1995), Vol. 8, pp. 556-559, the results of a study of the effects of the morphology of the second phase on warm stretch flange formability using TRIP composite structure steel (TDP steel consisting of ferrite (polygonal ferrite), bainite and γR) are reported. According to this reference, λ was higher in Type III, in which the second phase was fine and uniform, than in Type I, in which the second phase was connected (massive), but such an improvement in λ from warm working was found only when the stamping temperature Tp was raised to 150° C., and not when stamping was done at room temperature (FIG. 5).

The experimental results reported in this reference do not show an improvement effect on λ for stamping at room temperature even when the γR of the aforementioned TDP sheet steel was fine and uniform, and the improvement effect on λ was only obtained by raising the stamping temperature. Moreover, in the aforementioned reference it was also reported that the total elongation and uniform elongation of steel having γR in such a fine state were smaller than those of steel in which the second phase was connected (local elongation was greater).

Moreover, in Sugimoto, Koichi, Tsuyoshi Kondo, Mitsuyuki Kobayashi and Shunichi Hashimoto, "Warm stretch formability of TRIP composite structure steel (effects of second phase morphology-2)", Materials and Processes (Iron and Steel Institute of Japan, Collected Papers), CAMP-ISIJ 518 (1994), Vol. 7, p. 754, reporting the results of a study of the relationship between the second phase morphology (γR)

of the aforementioned TDP steel and its elongation characteristics (uniform elongation and total elongation), it is disclosed in apparent contradiction to the preceding reference that when γR is controlled as fine needles (Type III), the elongation properties at room temperature are better than those of the connected type (Type I), but when this fine needle-type γR steel is warm worked the elongation properties decline (FIG. 2).

Japanese Patent Application Laid-open No. 2004-091924 discloses that the carbon concentration in the retained austenite as the second phase (C γR) was set at or above a fixed value in a TRIP composite structure sheet steel while the proportion of lath-shaped retained austenite was increased in order to improve stretch flange formability.

Meanwhile, Japanese Patent Application Laid-open No. 2004-043908 (Claims) discloses a TPF steel comprising a matrix phase structure of ferrite and a second-phase structure of martensite and retained austenite, wherein the area rate of the second phase structure is stipulated, the minimum volume rate (Vt γR) of the retained austenite is stipulated, and the ratio of the volume rte of retained austenite in the ferrite grains (SF γR) to the aforementioned Vt γR (SF γR/Vt γR) is also stipulated.

SUMMARY OF THE INVENTION

Stretch flange formability is improved when the C concentration of the retained austenite of the second-phase structure (C γR) is increased and when the proportion of lath-shaped retained austenite is increased as in Japanese Patent Application Laid-open No. 2004-091924.

Moreover, stretch flange formability is indeed increased when the area rate of the second-phase structure and the volume rate of the retained austenite are stipulated within a fixed range as in Japanese Patent Application Laid-open No. 2004-43908.

However, in TRIP-type composite structure sheet steels such as the aforementioned TPF steel, the effect of the morphology of the second-phase structure is great, and if this is not clearly controlled elongation and stretch flange formability cannot be improved.

In terms of the morphology of the second phase structure, as described in Nagasaka et al, in the case of warm working gamma is greater when the second phase is fine and uniform than when it is connected (massive), but this effect does not hold in the case of stamping at room temperature.

Consequently, in TRIP-type composite structure steel such as the aforementioned TPF steel, the effects on stretch flange formability and the like of the morphology of this second phase structure have not always been clear in the past. Moreover, obtaining a TRIP-type composite structure sheet steel such as a TPF steel with both stretch flange formability and elongation properties appears to be a difficult task.

In light of the aforementioned circumstances, it is an object of the present invention to provide a 590 MPa class high-strength TRIP-type composite structure sheet steel of the aforementioned TPF type wherein not only are the effects of the morphology of the second phase structure on stretch flange formability and the like made obvious, but elongation and stretch flange formability at room temperature are improved by controlling the morphology of the second phase structure.

To achieve this object, the composite structure sheet steel with excellent elongation and stretch flange formability of the present invention is in essence a composite structure sheet steel which contains 0.02 to 0.12% C, 0.5 to 2.0% Si+Al and 1.0 to 2.0% Mn by mass, with the remainder comprising Fe and unavoidable impurities, and which comprises 80% or more polygonal ferrite (steel structure space factor) and 1 to 7% retained austenite (volume fraction measured by the saturation magnetization method), with the remainder being bainite and/or martensite. The second-phase structure of this composite structure is martensite and retained austenite, and within this second-phase structure the number of second phases with an aspect ratio of 1:3 or less and a mean grain size of 0.5 μm or more as observed under a scanning electron microscope at 4000× is not more than 15 per 750 $\mu m^2$.

Excluding the matrix phase of polygonal ferrite, the retained austenite (γR) and martensite of the steel structure of the present invention are defined as the "second phase structure".

According to our findings, in a TRIP-type composite structure sheet steel which is a TPF sheet steel comprising polygonal ferrite as the matrix phase and retained austenite, bulky, massive second phases of retained austenite or retained austenite transformed into martensite are starting points for damage during formation at room temperature, and certainly detract from stretch flange formability.

A TRIP-type composite structure sheet steel necessarily comprises the aforementioned second phase. However, when this second phase is bulky and massive, stretch flange formability is greatly reduced in TPF sheet steel. In contrast, stretch flange formability is reliably improved when the second phase is refined below a fixed level or in other words when the bulky, massive second phase is minimized as in the present invention.

By reducing this bulky, massive second phase it is also possible to improve elongation, a property which is normally inconsistent with stretch flange formability.

Moreover, the fineness of the second phase can be controlled as in the present invention without greatly altering the manufacturing processes of conventional sheet steel.

DESCRIPTION OF THE PREFERRED EMBODIMENTS

Steel Structure

Figure 1:
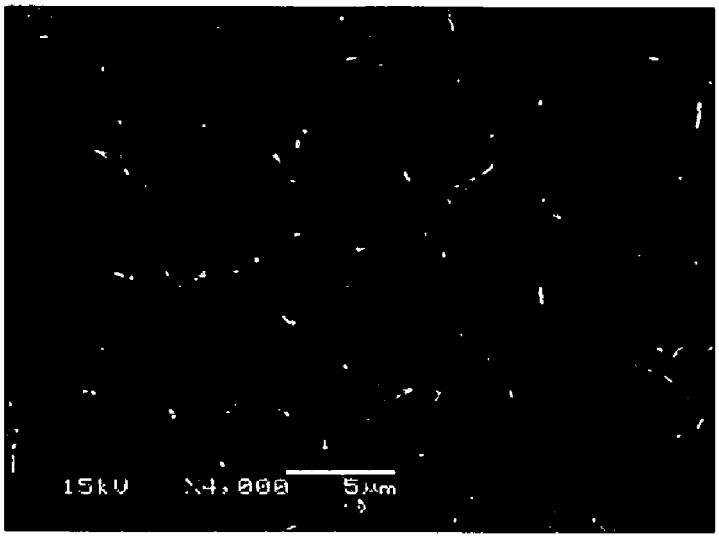
FIG. 1 is a photograph used in place of a drawing to illustrate a sheet steel structure of the present invention.

First, the steel structure of the present invention is explained below.

It is a precondition that the cold-rolled sheet steel of the present invention maintain excellent stretch flange formability with 590 MPa class high strength. Consequently, the steel structure is a TRIP-type composite structure comprising 80% or more polygonal ferrite (steel structure space factor) and 1 to 7% retained austenite (volume fraction measured by the saturation magnetization method), with the remainder being bainite and/or martensite, called the aforementioned TPF steel.

Polygonal Ferrite

When the space factor of the polygonal ferrite which is the main phase of the cold-rolled sheet steel structure of the present invention is under 80%, the effects of the polygonal ferrite in ensuring elongation and stretch flange formability at a high strength of 590 MPa are not obtained. Consequently, the space factor of polygonal ferrite in the total structure is set at 80% or more in order to ensure elongation and stretch flange formability.

Polygonal ferrite is a polygonal, massive ferrite having a lower structure with no or very little dislocation density, and differs from bainitic ferrite, a sheet-shaped ferrite having a lower structure with high dislocation density (which may either have or not have lath-shaped structures) and also from quasi-polygonal ferrite structures, which have lower structures of fine sub-grains and the like (see "Bainite Photographs of Steel-1," issued by the Basic Research Group of the Iron and Steel Institute of Japan).

Because of the aforementioned properties, polygonal ferrite can be clearly distinguished from bainitic ferrite and quasi-polygonal ferrite by scanning electron microscopy (SEM) as described below.

That is, in an SEM structural photograph polygonal ferrite is black with a polygonal shape and contains no retained austenite or martensite. On the other hand, bainitic ferrite appears dark gray in an SEM structural photograph, and in many cases the bainitic ferrite cannot be distinguished from bainite, retained austenite or martensite.

The space factors of polygonal ferrite and other transformed structures such as bainite and martensite were measured as area rates by the aforementioned image analysis after structural observation of ¼ the thickness of a sheet steel by SEM (magnification 4000). Specifically, the sheet steel was first corroded with nital and observed by SEM (magnification 4000), and a plane parallel to the rolling plane at a position (t/4 position) about ¼ the thickness of the sheet was photographed. In this photograph the structures which turned white from corrosion were traced, and the space factors of each structure were measured as area percentages using commercial imaging software (Image-Pro Plus, Media Cybernetics).

Retained Austenite

Retained γ is an essential structure for achieving TRIP (transformation-induced plasticity) effects, and is useful for improving elongation (ductility). To effectively achieve such results, the space factor of retained γ in the total structure is 1% or more. If it exceeds 7% local deformability and stretch flange formability will decline. Hence, the space factor of retained γ is fixed at a relatively low level of 1 to 7%.

In the present invention, the remainder of the steel structure may be a composite structure comprising bainite and/or martensite as long as the aforementioned space factors of polygonal ferrite and retained austenite apply.

Measuring γR Space Factor

Unlike the aforementioned polygonal ferrite and other structures, the aforementioned space factor (%) of retained austenite is measured as a volume percentage (volume fraction) by the known saturation magnetization method. The saturation magnetization measurement method is known to be a more precise method of quantifying retained austenite than x-ray diffraction. For details about this measurement method see the aforementioned Japanese Patent Application Laid-open No. 2004-043908.

Specifically, the saturation magnetization (I) of a measurement sample with a specific shape (3.6 mmt×4 mmW×30 mmL test piece) and the saturation magnetization (Is) of effectively the same components as the measurement sample with a 0% γR volume percentage were measured or calculated, and the amount of γR in the measurement sample was calculated based on the following formula: γR (volume%)=(1−I/Is)×100.

Using the known saturation magnetization measurement device described in the aforementioned Japanese Patent Application Laid-open No. 2004-043908, with an electrode gap of 30 mm and an applied magnetization of 5000 to 10,000 Oe (oersted) at room temperature, the mean value of bipolar maximum magnetization of a hysteresis loop is taken as saturation magnetization. Because the aforementioned saturation magnetization is liable to the effects of changes in the measurement temperature, measurement at room temperature should be within the range of 23° C.±3° C. for example.

Steel pieces 1.2 mmt×4 mmW×30 mmL (three pieces cut by wire cutting from both ends to near the center of the resulting sheet steel taking great care not to create strain, and layered to a total thickness of 3.6 mmt) are used for the measurement sample. The electrode gap is 30 mm, the applied magnetization at room temperature is 5000 Oe (oersted), and the mean value of bipolar maximum magnetization of the hysteresis loop is taken as saturation magnetization. After saturation magnetization (I) of the aforementioned measurement sample has been measured by the methods described above, the saturation magnetization (Is) of the sample is measured with the γR reduced to 0% volume by austempering for 15 minutes at 420° C. for example, and these values are substituted in the aforementioned formula to obtain the γR volume percentage (Vt γR).

Second Phase Structure

In the present invention, presuming a composite structure such as the aforementioned, the amount of the second phase structure of retained austenite and martensite which is bulky and massive (hereunder sometimes called simply the second phase structure) is reduced in order to effectively improve elongation and stretch flange formability.

This bulky, massive second phase is defined more particularly as the massive second phase with an aspect ratio of 1:3 or less and a mean grain size of 0.5 μm or more. A fine second phase with an aspect ratio above 1:3 and a mean grain size of less than 0.5 μm is not a starting point of damage during stamping and hole enlarging, and does not detract from elongation and stretch flange formability. On the other hand, the bulky, massive second phase defined above is a starting point of damage during stamping and hole enlarging, and does detract from elongation and stretch flange formability.

Consequently, in the present invention the number of bulky, massive second phases as defined above is reduced to 15 or less per 750 $\mu m^2$ as observed under a scanning electron microscope at 4000×.

If there are more than 15 of the bulky, massive second phases defined above per 750 $\mu m^2$ as observed under the aforementioned conditions for observing the composite structure, the critical number of starting points for damage during stamping is exceeded, and stretch flange formability definitely declines. Elongation is also lower.

Consequently, in the present invention the number of bulky, massive second phases with an aspect ratio of 1:3 or less and a mean grain size of 0.5 μm or more as defined above is 15 or less per 750 $\mu m^2$ as observed under a scanning electron microscope at 4000×.

Chemical Composition

Next, the basic components making up the sheet steel of the present invention are explained. Chemical components are all given as mass percentages. In the present invention, the sheet steel fundamentally contains 0.02 to 0.12% C, 0.5 to 2.0% Si+Al and 1.0 to 2.0% Mn, with the remainder being Fe and unavoidable impurities.

In addition, one or two or more of 0.1% or less (not including 0%) Ti, 0.1% or less (not including 0%) Nb, and 0.1% or less (not including 0%) V may be included in this basic composition. Moreover, one or two or more of 1.0% or less (not including 0%) Mo, 0.5% or less (not including 0%) Ni, and 0.5% or less (not including 0%) Cu may be included. In addition, one or two of 0.003% or less (not including 0%) Ca and 0.003% or less (not including 0%) REM may be included.

Next, the contents of the elements and the reasons for inclusion are explained.

C: 0.02 to 0.12%

C is a necessary element for steel strength and providing γR. If the C content is less than 0.02%, there will be very little γR in a hot-rolled sheet steel after it has been coiled or in a cold-rolled sheet steel after it has been annealed, and it will be hard to ensure a space factor of 1% or more with respect to the total structure. Consequently, the desired TRIP effect from γR will not be obtained. If the C content exceeds 0.12%, more of the bulky, massive second phase defined above will be produced, increasing the number of starting points for damage and detracting from elongation and stretch flange formability. Consequently, the C content is set in the range of 0.02 to 0.12%.

Si+Al:0.5 to 2.0%

Si and Al are elements which prevent γR from breaking down and generating carbides. Moreover, Si is a solid solution strengthening element, while Al is also useful as a deoxidizing element. To achieve these effects, the total content of Si and Al needs to be 0.5% or more. If the total content of Si and Al is less than 0.5%, there is much less γR, and space factor of 1% or more of the total structure cannot be ensured. Consequently, the desired TRIP effects from γR cannot be adequately obtained.

On the other hand, if the total content of Si and Al exceeds 2.0% the effects become saturated, and instead heat brittleness occurs, making cracks more likely during rolling. Consequently, the total content of Si and Al is in the range of 0.5 to 2.0%.

Mn: 1.0 to 2.0%

Mn is an element which stabilizes austenite and contributes to γR production. If the Mn content is less than 1.0%, there is much less γR in the sheet steel, and an occupying volume rate of 1% or more of the total structure cannot be ensured. Consequently, the desired TRIP effects from γR cannot be adequately obtained. On the other hand, if the Mn content exceeds 2.0%, the aforementioned effects become saturated and in fact there are adverse effects such as cracking of the cast piece. Consequently, the Mn content is in the range of 1.0 to 2.0%.

The present invention fundamentally contains the aforementioned components, with the remainder being Fe and unavoidable impurities, but may also contain the following allowable components to the extent that the properties of the sheet steel of the present invention are not sacrificed.

One or Two or More of Ti, Nb and V

Each of these components contributes to high strength by strengthening precipitation and producing a finer structure. To effectively achieve these effects, in the case of selective inclusion, one or two or more of 0.1% or less (not including 0%) Ti, 0.1% or less (not including 0%)Nb and 0.1% or less (not including 0%) V is included. If the content of any one of these elements exceeds the maximum of 0.1% carbides are produced and the desired γR content cannot be obtained.

One or Two or More of Mo, Ni and Cu

These elements are all steel strengthening elements which stabilize the austenite and contribute to γR production. To effectively achieve these effects, in the case of selective inclusion, one or two or more of 1.0% or less (not including 0%) of Mo, 0.5% or less (not including 0%) of Ni and 0.5% or less (not including 0%) of Cu is included. However, if the content of any one of these elements exceeds the upper limit of 0.1%, cracking is likely to occur during rolling.

One or Two of Ca and REM

Ca and REM control the morphology of sulfides in the steel, and are effective for improving workability. In order to effectively achieve such effects, in the case of selective inclusion, one or two of 0.003% or less (not including 0%) Ca and 0.003% or less (not including 0%) REM is included. However, a content exceeding 0.003% of either of these elements is not economical because the effects become saturated.

Elements other than these are impurities, and their content should be as small as possible. For example, P should be 0.15% or less, S should be 0.02% or less and N should be 0.02% or less.

Next, the method of manufacturing the sheet steel of the present invention is explained below.

The sheet steel of the present invention can be manufactured by ordinary methods of manufacturing 590 MPa grade high-strength TRIP (strain-induced transformation) cold-rolled sheet steel from steel-making through hot- and cold-rolling, except for the conditions for continuous annealing of the cold-rolled sheet steel.

For example, conditions such as hot rolling at or above the Ar3 point followed by cooling at a mean cooling speed of 30° C./s and coiling at a temperature of about 500 to 600° C. can be adopted for the hot rolling step.

A cold-rolling rate of about 30 to 70% is recommended for cold rolling. The continuously annealed cold-rolled sheet steel becomes the cold-rolled sheet steel product either as is without surface treatment, or after being surface treated as necessary by electroplating, hot dipping, chemical surface treatment or surface coating or the like.

The continuous annealing conditions for the cold-rolled sheet steel are vital for providing a composite structure sheet steel with a steel structure consisting of 80% or more polygonal ferrite (structural space factor) and 1 to 7% retained austenite with the remainder being bainite and/or martensite, wherein the second phase of retained austenite and martensite in this composite structure is fine with little bulky, massive second phase, providing excellent elongation and stretch flange formability.

To this end, in continuous annealing the cold-rolled sheet steel must be first heated to the austenite (γ) temperature field at or above the A3 point, and then cooled as rapidly as possible to the bainite transition range at a mean cooling speed of 30° C./s or more. First heating the cold-rolled sheet steel to the austenite (γ) temperature field and then supercooling it from this gamma field increases the nuclei for ferrite transition. Ferrite grain growth is likely to be more uniform than it is in the case of heating to the normal two-phase field (between the A1 point and A3 point) and cooling from that two-phase field, and the second phase can be made finer with less bulky, massive second phase as stipulated above.

When the continuous annealing conditions consist of heating to the normal two-phase field (between the A1 point and A3 point) followed by cooling from that two-phase field, there is more of the bulky, massive second phase in particular, detracting from elongation and stretch flange formability. The lack of improvement in the elongation and stretch flange formability of the aforementioned 590 MPa grade high-strength TRIP sheet steel of the TPF type is attributed to these continuous annealing conditions.

Even if the steel is heated to the austenite (γ) temperature field in continuous annealing, if the cooling speed is too slow the second phase of retained austenite and martensite in the composite structure will not be fine as stipulated above, and there will be more of the bulky, massive second phase. There is no particular upper limit to the mean cooling speed, which can be as fast as possible but should be controlled appropriately for actual operating purposes.

The present invention is explained in detail below based on examples. However, the following examples do not limit the present invention, and changes which do not deviate from the intent of what is stated above and below are included in the technical scope of the present invention.

EXAMPLES

Steel pieces having the chemical composition shown in Table 1 (units in table are mass percentages) were continuously cast, and the resulting slabs were heated to 1200° C., finish rolled at 900° C. and cooled, and coiled at about 500° C. to obtain hot-rolled sheet steels about 3 mm thick. After a cold-rolling step to obtain a thickness of 1.2 mm, these were recrystallization annealed (continuously annealed) by a continuous annealing line (CAL) at the various heating temperatures and cooling speeds shown in Table 2 and, cooled to the bainite transition field to obtain various cold-rolled sheet steels.

The yield strength (YP:MPa), tensile strength (TS:MPa) and total elongation (T-EL:%) of each of the resulting sheet steels were measured using a JIS #5 pull test piece.

Hole expandability λ (%) was measured to evaluate the stretch flange formability of each sheet steel. Hole expandability λ was measured by punching holes of d0=10 mm Φ in test pieces (sheet thickness×100 mm×100 mm) taken from the various sheet steels obtained above in accordance with Japan Iron and Steel Federation standard JFST 1001, then widening each punched hole by inserting a conical punch with an apex angle of 60° C. from the side opposite the side having burr on the shear face, and measuring the hole diameter (mm) at which the cracks on the edge of the hole penetrated the thickness of the sheet. λ (%) was then calculated as $[(d-d0)/d0]\times100$. The results are shown in Table 2.

In the present invention, a sheet steel fulfilling all the conditions of a tensile strength of 590 MPa or more, a total elongation of 30% or more, a λ of 80% or more, a TS×EL (MPa %) of 19000 or more and a TS×λ (MPa %) of 54000 or more was judged to be an "example of the present invention" with excellent elongation and stretch flange formability.

Moreover, the area percentage of polygonal ferrite was derived from image analysis and the volume fraction of retained austenite was measured by the saturation magnetization method. Moreover, the number of second-phase masses with an aspect ratio of 1:3 or less and a mean grain size of 0.5 μm or more in the second phase of retained austenite and martensite in the composite structure was observed under a scanning electron microscope at 4000× and given as the number of masses per 750 $\mu m^2$. These results are shown in Table 2.

In both the invention examples and comparative examples, the remaining steel structure apart from the polygonal ferrite and retained austenite measured above consisted of bainite and martensite (shown as B+M in Table 2) as measured according to the image analysis measurement methods described above.

As is clear from Table 2, the structural requirements of the present invention are fulfilled by invention examples 1 through 13 in which the heating temperature for continuous annealing was in the γ field and the cooling speed was fast using steels B, C, and F through N of Table 1 which were within the composition range of the present invention. That is, when the space factor of polygonal ferrite was 80% or more and the volume fraction of retained austenite was 1 to 7% as measured by the saturation magnetization method, the number of bulky, massive second phase structures with an aspect ratio of 1:3 or less and a mean grain size of 0.5 μm or more was 15 or less per 750 $\mu m^2$ as observed under a scanning electron microscope at 4000×. This resulted in a tensile strength of 590 MPa or more and excellent elongation and stretch flange formability, fulfilling all the aforementioned conditions.

In contrast, in Comparative Example 17 and 19 in which invention steels B and C were used but the heating temperature for continuous annealing was too low (in the two-phase field), although the space factor of polygonal ferrite and the volume fraction of retained austenite were satisfactory, there were two many bulky, massive second phase structures. As a consequence, elongation and stretch flange formability were much poorer.

Compared to Invention Examples 1 and 2 using Steel B and Invention Example 3 using Steel C of the invention examples, Invention Examples 2 and 4 in which the cooling speed for continuous annealing was relatively slow exhibited more of the bulky, massive second phase than did Invention Examples 1 and 3, in which the cooling speed was relatively fast. Consequently, elongation and stretch flange formability were relatively poor.

Moreover, in the case of Comparative Examples 18 and 20 in which the cooling speed for continuous annealing deviated from the preferred conditions, being even slower than in Invention Examples 2 and 4 even though the same Invention Steel B was used, the number of bulky, massive second phases exceeded the upper limit for the present invention. Consequently, elongation and stretch flange formability were very poor.

Figure 2:
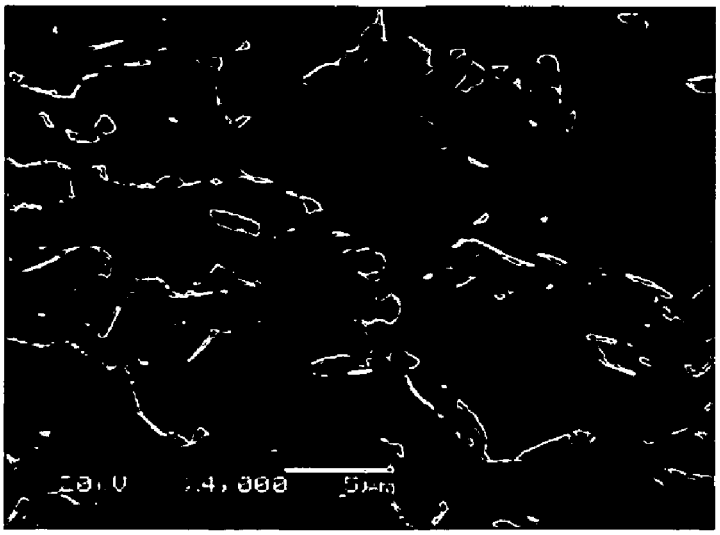
FIG. 2 is a photograph used in place of a drawing to illustrate the sheet steel structure of a comparative example.

Scanning electron microscope images of the steel structures of Invention Example 1 and Comparative Example 17 at a magnification of 4000 (photographs substituted for drawings) are shown in FIGS. 1 and 2, respectively. In FIG. 1 representing Invention Example 1, only three bulky, massive second phases as defined above are observed, while in FIG. 2 of Comparative Example 17, many (17) bulky, massive second phases as defined above are observed.

In FIGS. 1 and 2, the polygonal ferrite of the main phase is observed in many places as black, polygonal shapes. The bainite and martensite are hard to distinguish visually, and can only be distinguished by image analysis.

From these results it appears that the number of bulky, massive second phases has a critical significance for elongation and stretch flange formability. This also supports the significance of favorable conditions of heating temperature and cooling speed for continuous annealing in order to reduce the number of bulk, massive second phases.

Comparative Example 14 falls below the lower limit for C content of Steel A in Table 1. Consequently, the occupying volume rate of γR in the sheet steel falls below the lower limit of 1%. As a result, the desired TRIP effects of γR are not adequately obtained, resulting in poor strength and strength-ductility balance.

Comparative Example 15 exceeds the upper limit for C content of Steel D in Table 1. Consequently, the number of bulky, massive second phases as stipulated above exceeds the upper limit, and elongation and stretch flange formability are very poor.

In Comparative Example 16, the content of Si in Steel E in Table 1 is too low. Consequently, the content of Si+Al falls below the lower limit, and the occupying volume rate of γR in the sheet steel falls below the lower limit of 1%. As a result, the desired TRIP effects of the γR are not adequately obtained, resulting in poor strength and strength-ductility balance.

TABLE 1

| Classification | Symbol | Chemical composition of sheet steel (mass %, remainder Fe) | | | | | | | | | | |
|---|---|---|---|---|---|---|---|---|---|---|---|---|
| | | C | Si | Mn | P | S | Al | Si + Al | N | Ti, Nb, V | Mo, Ni, Cu | Ca, REM |
| Comparative Example | A | 0.015 | 1.20 | 1.51 | 0.02 | 0.003 | 0.030 | 1.23 | 0.0040 | — | — | — |
| Invention Example | B | 0.040 | 1.21 | 1.50 | 0.02 | 0.003 | 0.030 | 1.24 | 0.0040 | — | — | — |
| Invention Example | C | 0.079 | 1.18 | 1.51 | 0.02 | 0.003 | 0.030 | 1.21 | 0.0040 | — | — | — |
| Comparative Example | D | 0.149 | 1.20 | 1.50 | 0.02 | 0.003 | 0.030 | 1.23 | 0.0040 | — | — | — |
| Comparative Example | E | 0.059 | 0.02 | 1.52 | 0.02 | 0.003 | 0.030 | 0.05 | 0.0040 | — | — | — |
| Invention Example | F | 0.061 | 0.70 | 1.49 | 0.02 | 0.003 | 0.030 | 0.73 | 0.0040 | — | — | — |
| Invention Example | G | 0.051 | 1.21 | 1.51 | 0.02 | 0.003 | 0.030 | 1.24 | 0.0040 | Nb 0.05 | — | — |
| Invention Example | H | 0.050 | 1.19 | 1.50 | 0.02 | 0.003 | 0.030 | 1.22 | 0.0040 | — | Ni 0.2, Cu 0.2 | — |
| Invention Example | I | 0.060 | 1.21 | 1.50 | 0.02 | 0.003 | 0.030 | 1.24 | 0.0040 | — | — | Ca 0.001 |
| Invention Example | J | 0.051 | 1.20 | 1.50 | 0.02 | 0.003 | 0.030 | 1.23 | 0.0040 | Ti 0.05, Nb 0.05 | Mo 0.2, | — |
| Invention Example | K | 0.050 | 1.20 | 1.69 | 0.02 | 0.003 | 0.030 | 1.23 | 0.0040 | — | Mo 0.2, Cu 0.2 | Ca 0.001 |
| Invention Example | L | 0.049 | 1.20 | 1.51 | 0.02 | 0.003 | 0.030 | 1.23 | 0.0040 | Ti 0.05, V 0.05 | — | REM 0.001 |
| Invention Example | M | 0.050 | 1.19 | 1.52 | 0.02 | 0.003 | 0.030 | 1.22 | 0.0040 | Ti 0.05 | Ni 0.2 | REM 0.001 |
| Invention Example | N | 0.041 | 1.21 | 1.50 | 0.02 | 0.003 | 0.030 | 1.24 | 0.0040 | Nb 0.05, V 0.05 | Mo 0.2, Ni 0.2 | Ca 0.001, REM 0.001 |

TABLE 2

| | | | Sheet steel structure | | | | | | Sheet steel tensile properties | | | | | |
|---|---|---|---|---|---|---|---|---|---|---|---|---|---|---|
| | | | Continuous annealing conditions | | | | Number of bulky, | | | | | | | |
| Class. | No. | Steel type Table 1 | Heating temperature (° C.) | Cooling speed (° C./s) | α Percentage (%) | γR Percentage (%) | massive second phases | Re-main-der | YP (Ma) | TS (MPa) | EL (%) | λ (%) | TS × EL (MPa %) | TS × λ (MPa %) |
| Invention Example | 1 | B | 930 | 50 | 94 | 1.4 | 3 | B + M | 498 | 610 | 33.0 | 93 | 20130 | 56730 |
| | 2 | B | 930 | 30 | 96 | 2.1 | — | B + M | 502 | 592 | 34.0 | 87 | 20128 | 51504 |
| | 3 | C | 930 | 40 | 92 | 4.8 | 8 | B + M | 475 | 638 | 34.0 | 85 | 21692 | 54230 |
| | 4 | C | 930 | 30 | 93 | 5.0 | 12 | B + M | 488 | 617 | 34.0 | 81 | 20978 | 49977 |
| | 5 | F | 930 | 40 | 92 | 3.7 | 5 | B + M | 489 | 631 | 33.0 | 92 | 20823 | 58052 |
| | 6 | G | 930 | 40 | 94 | 3.9 | 4 | B + M | 523 | 622 | 33.0 | 95 | 20526 | 59090 |
| | 7 | H | 930 | 40 | 92 | 4.5 | 8 | B + M | 511 | 641 | 31.0 | 86 | 19871 | 55126 |
| | 8 | I | 930 | 40 | 92 | 5.2 | 11 | B + M | 490 | 621 | 32.0 | 87 | 19872 | 54027 |
| | 9 | J | 930 | 40 | 93 | 4.9 | 9 | B + M | 481 | 630 | 32.0 | 90 | 20160 | 56700 |
| | 10 | K | 930 | 40 | 92 | 5.0 | 10 | B + M | 495 | 627 | 33.0 | 91 | 20691 | 57057 |
| | 11 | L | 930 | 40 | 92 | 4.2 | 9 | B + M | 505 | 620 | 33.0 | 87 | 20460 | 53940 |
| | 12 | M | 930 | 40 | 91 | 4.5 | 8 | B + M | 507 | 611 | 34.0 | 91 | 20774 | 55601 |
| | 13 | N | 930 | 40 | 94 | 6.0 | 7 | B + M | 511 | 635 | 31.0 | 97 | 19685 | 61595 |
| Comparative Example | 14 | A | 930 | 40 | 98 | 0.6 | 1 | B + M | 478 | 520 | 32.0 | 120 | 16640 | 62400 |
| | 15 | D | 930 | 40 | 81 | 10.5 | 27 | B + M | 487 | 776 | 25.0 | 53 | 19400 | 41128 |
| | 16 | E | 930 | 40 | 89 | 0.0 | 3 | B + M | 489 | 578 | 22.0 | 91 | 12716 | 52598 |
| | 17 | B | 850 | 40 | 92 | 3.9 | 17 | B + M | 396 | 542 | 36.0 | 70 | 19512 | 37940 |
| | 18 | B | 930 | 25 | 96 | 1.5 | 18 | B + M | 505 | 585 | 34.0 | 71 | 19890 | 41535 |
| | 19 | C | 850 | 40 | 87 | 4.5 | 25 | B + M | 417 | 580 | 34.0 | 72 | 19720 | 41760 |
| | 20 | C | 930 | 20 | 94 | 4.5 | 20 | B + M | 495 | 602 | 33.0 | 59 | 19866 | 35518 |

As explained above, the present invention provides a TRIP composite structure sheet steel of the aforementioned TPF type whereby not only are the effects of the morphology of the second-phase structure made obvious, but elongation and stretch flange formation at room temperature are improved by controlling the morphology of the second-phase structure. Consequently, the sheet steel of the present invention is applicable in the automobile, electrical and machine fields and the like to structural materials such as panels and frames which need to have excellent strength and formability

What is claimed is:

1. A composite structure cold-rolled sheet steel with excellent elongation and stretch flange formability comprising 0.02 to 0.12% C, 0.5 to 2.0% Si+Al and 1.0 to 2.0% Mn by mass percentage, with the remainder being Fe and unavoidable impurities, the sheet steel having a composite structure comprising 80% or more polygonal ferrite (steel structure space factor) and 1 to 7% retained austenite (volume fraction measured by the saturation magnetization method), with the remainder being bainite and martensite, wherein the polygonal ferrite is defined as a main-phase structure and martensite and retained austenite is defined as a second-phase structure, and within the second-phase structure, not more than 15 massive second-phase structures with an aspect ratio of 1:3 or less and a mean grain size of 0.5 μm or more are contained per 750 $\mu m^2$ as observed under a scanning electron microscope at 4000×.

2. The composite structure sheet steel with excellent elongation and stretch flange formability according to claim 1, containing one or two or more of 0.1% or less (not including 0%) Ti, 0.1% or less (not including 0%) Nb, and 0.1% or less (not including 0%) V by mass percentage.

3. The composite structure sheet steel with excellent elongation and stretch flange formability according to claim 1, containing one or two or more of 1.0% or less (not including 0%) Mo, 0.5% or less (not including 0%) Ni, and 0.5% or less (not including 0%) Cu by mass percentage.

4. The composite structure sheet steel with excellent elongation and stretch flange formability according to claim 1, containing one or two of 0.003% or less (not including 0%) Ca and 0.003% or less (not including 0%) REM by mass percentage.

5. The composite structure sheet steel with excellent elongation and stretch flange formability according to claim 2, containing one or two or more of 1.0% or less (not including 0%) Mo, 0.5% or less (not including 0%) Ni, and 0.5% or less (not including 0%) Cu by mass percentage.

6. The composite structure sheet steel with excellent elongation and stretch flange formability according to claim 2, containing one or two of 0.003% or less (not including 0%) Ca and 0.003% or less (not including 0%) REM by mass percentage.

7. The composite structure sheet steel with excellent elongation and stretch flange formability according to claim 3, containing one or two of 0.003% or less (not including 0%) Ca and 0.003% or less (not including 0%) REM by mass percentage.

8. The composite structure sheet steel with excellent elongation and stretch flange formability according to claim 5, containing one or two of 0.003% or less (not including 0%) Ca and 0.003% or less (not including 0%) REM by mass percentage.

9. The composite structure sheet steel with excellent elongation and stretch flange formability according to claim 1, which has a tensile strength (TS) of 590 MPa or more, a total elongation (EL) of 30% or more, a hole expandability (λ) of 80% or more, a TS×EL (MPa %) of 19000 or more, and a TS×λ (MPa %) of 54000 or more.

10. The composite structure sheet steel with excellent elongation and stretch flange formability according to claim 1, which is obtained by a process comprising steel-making through hot-rolling followed by cold-rolling, and then continuous annealing by heating to the austenite (γ) temperature field at or above the A3 point, and then cooling to the bainite transition range at a mean cooling speed of 30° C./s or more.

11. A process for making the composite structure sheet steel with excellent elongation and stretch flange formability according to claim 1, comprising steel-making through hot-rolling followed by cold-rolling, and then continuous annealing by heating to the austenite (γ) temperature field at or above the A3 point, and then cooling to the bainite transition range at a mean cooling speed of 30° C./s or more.

* * * * *